United States Patent [19]

Anderson

[11] 3,975,118

[45] Aug. 17, 1976

[54] NON-CONTACTING SHAFT SEAL

[75] Inventor: Carl E. Anderson, Des Plaines, Ill.

[73] Assignee: Addressograph Multigraph Corporation, Cleveland, Ohio

[22] Filed: June 3, 1974

[21] Appl. No.: 475,761

[52] U.S. Cl. ..... 417/424; 277/133

[51] Int. Cl.[2] ..... F04B 17/00

[58] Field of Search ..... 277/133, 135, 81 R, 277/83, 53; 417/424, 423

[56] References Cited

UNITED STATES PATENTS

| | | | |
|---|---|---|---|
| 2,407,218 | 9/1946 | Beier | 277/133 |
| 3,576,380 | 4/1971 | Sargeant | 417/423 R |
| 3,664,760 | 5/1972 | Reiner | 417/423 R |
| 3,790,312 | 2/1974 | Bottoms | 417/424 |
| 3,871,796 | 3/1975 | Mack | 417/424 |

*Primary Examiner*—Richard E. Aegerter
*Assistant Examiner*—L. Footland
*Attorney, Agent, or Firm*—Mason, Kolehmainen, Rathburn & Wyss

[57] ABSTRACT

A non-contacting shaft seal for preventing the flow of fluid through a shaft passageway in a housing wall includes a collar fixedly attached to a rotating shaft for creating a zone of turbulence around the passageway. The collar has a diameter larger than the diameter of the shaft passageway and is slightly physically spaced from the housing wall to confine the turbulence to the area between the collar and the housing wall to thereby create a generally annularly shaped zone of turbulence or turbulence barrier around the passageway.

2 Claims, 4 Drawing Figures

NON-CONTACTING SHAFT SEAL

BACKGROUND OF THE INVENTION

1. Field of the Invention

The invention relates generally to sealing systems and, more particularly, to non-contacting types of sealing systems for preventing the flow of a fluid through a passageway provided in a wall around a rotating shaft such as an impeller drive shaft for a pump.

2. Prior Art

Several techniques for preventing the flow of fluids through shaft passageways are known. One such system utilizes a closely fitted sealed bearing filled with sealing material for sealing the shaft passageway. Another such system utilizes a dynamic seal commonly known as a slinger seal including a rotating slinger for centrifugally repelling fluids, particularly liquids, away from the shaft.

Although these techniques do prevent the flow of fluids through shaft passageways, sealed bearings are expensive and difficult to manufacture; and slinger-type seals tend to create turbulence in the fluid in which they are immersed. In many applications, where the fluid is a volatile or chemically active liquid, turbulence cannot be tolerated because the foaming caused by the turbulence tends to evaporate or to change the chemical composition of the liquid. An example of such a fluid is the liquid developer used in photocopying machines that must be pumped from a developer tank to a developing station without excessive turbulence to avoid adversely affecting the developing characteristics of the developer.

SUMMARY

It is an object of the present invention to provide a non-contacting seal for preventing the leakage of fluid around a rotating shaft.

It is another object of the present invention to provide a non-contacting dynamic shaft seal that does not cause excessive turbulence in the fluid in contact therewith.

It is a further object of the present invention to provide a seal for a rotating shaft that is relatively simple and inexpensive to manufacture.

It is yet another object of the present invention to provide a submersible pump for pumping liquids without excessive turbulence or foaming.

A further object of the present invention is to provide a submersible impeller type pump for liquids that effectively prevents the entry of air into the pump housing around the impeller drive shaft.

In accordance with a preferred embodiment of the invention, a non-contacting shaft seal is used in conjunction with a submersible impeller type pump to prevent the entry of air into the pump housing. The pump housing is provided with an aperture or passageway in a wall thereof for receiving an impeller drive shaft. An annular collar having a diameter larger than the diameter of the aperture is mounted on the drive shaft and spaced approximately 0.005 to 0.050 inches from the housing wall. The shaft causes the annular collar to rotate and generate localized turbulence around the perimeter of the collar confined to an area between the collar and the wall of the housing. This turbulence provides an effective barrier around the aperture to prevent the leakage of air into the aperture when the level of the liquid being pumped is below the level of the aperture. Such a seal is particularly useful for submersible pumps for preventing the leakage of air around the shaft into the pump housing; but the seal according to the invention described in the following specification may be used in conjunction with any device requiring the separation of two fluids to be maintained.

DETAILED DESCRIPTION OF THE INVENTION

Figure 1:
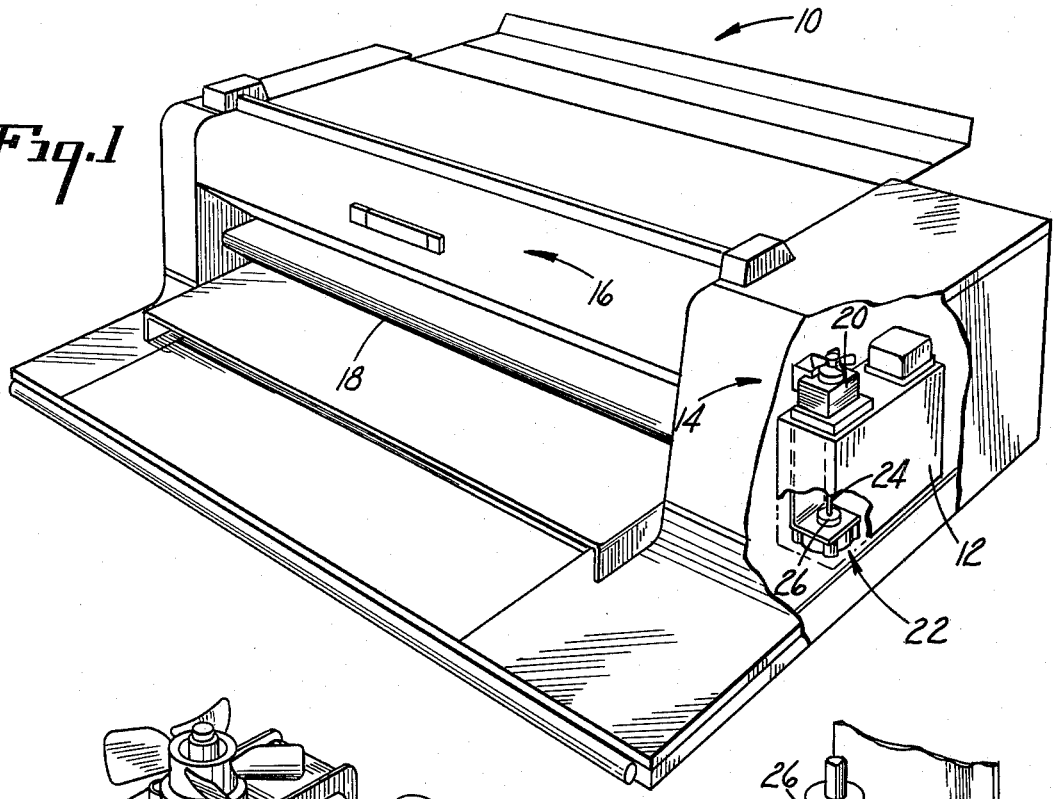
FIG. 1 is a sectional perspective view of a duplicating machine utilizing a liquid developer pump having the seal according to the invention incorporated therein.

Having reference now to the drawings and initially to FIG. 1 there is illustrated a photocopying machine 10 having a developer tank 12 containing a developer pump assembly 14, a developing station 16 and a slot 18 for receiving the originals to be copied. The developer pump assembly 14 has a drive motor 20, a pump housing 22 and an impeller drive shaft 24. The function of the pump assembly 14 is to pump liquid developer from the developer tank 12 to the developing station 16 where the developing of the photocopies is accomplished. The developing station 16 contains a conventional trough for receiving the liquid developer from the tank 12 and an applicator (not shown) for applying the liquid developer to specially treated photosensitive paper.

In order to assure proper developing of the photocopies by the machine 10, the liquid developer must be pumped from the developer tank 12 to the developing station 16 without the introduction of an appreciable amount of air into the liquid developer. The pumping of the liquid developer without the introduction of air is easily achieved when the developer tank 12 is relatively full; however, as the level of the liquid developer in the tank 12 is lowered and approaches the top of the pump housing 22, air may be introduced into the pump housing around the drive shaft 24. The introduction of air into the pump housing causes frothing of the liquid developer, thereby impairing the efficiency of the developer, and further causes annoying noises to be generated by the pump. The pump seal according to the present invention provides a way to avoid frothing and noise problems present in prior art liquid developer pumps.

In accordance with an important feature of the present invention, the pump assembly 14 is provided with a novel non-contacting shaft seal. The novel shaft seal is embodied in the illustrated pump assembly 14 by a collar 26. The collar 26 serves to generate localized turbulence about the drive shaft 24 to prevent the flow of air into the pump housing 22 when the level of the liquid developer drops below the top of the housing.

Figure 2:
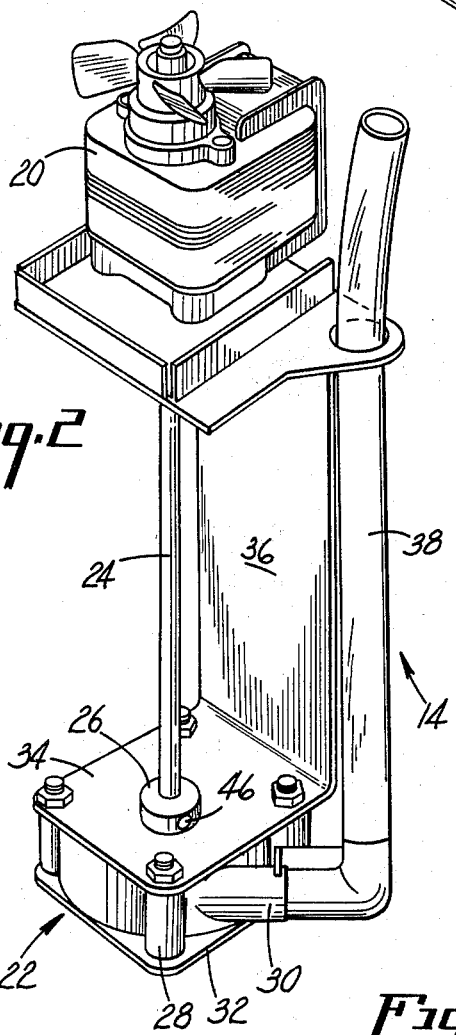
FIG. 2 is a perspective view of the liquid developer pump shown in FIG. 1 utilizing the seal according to the invention.

Proceeding now to a more detailed description of the illustrated embodiment of the invention, and with particular reference to FIG. 2, there is shown the pump housing 22 having a scroll portion 28, an outlet 30, a bottom plate 32 and a top plate 34. The top plate 34 forms part of a bracket 36 for mounting the motor 20 to the housing 22. A conduit tube 38 is connected to the outlet 30 and serves to carry the liquid developer to the developing area 16.

Figure 3:
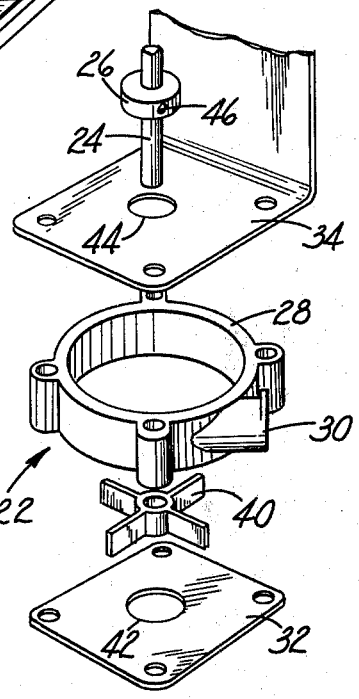
FIG. 3 is an exploded perspective view of the impeller and pump housing of the pump of FIG. 2 showing the sealing collar according to the invention.
Figure 4:
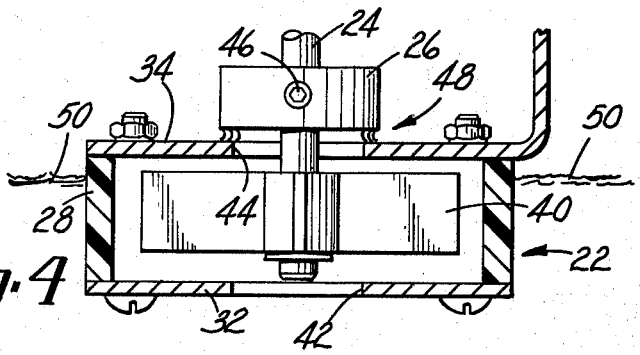
FIG. 4 is a sectional side view of the pump housing showing the sealing collar and the localized turbulence generated in the space between the collar and the pump housing.

The pump housing 22 (FIGS. 3 and 4) encloses an impeller 40 which is fixedly attached to the shaft 24 for rotation therewith. In operation, the liquid developer enters the pump housing 22 through an inlet aperture 42 in the bottom plate 32 and is expelled through the outlet 30 by the rotating impeller 40. The operation thus far described is conventional and common to impeller type pumps. In conventional impeller type pumps, liquid may also enter the pump housing through an aperture provided for the impeller drive shaft, such as the aperture 44 in the illustrated embodiment. Such pumps function satisfactorily as long as the level of the liquid remains above the level of the aperture 44. However, when the level of the liquid drops below the level of the aperture 44, the pump is still capable of pumping liquid, but the entry of air through the aperture 44 causes the undesirable effects previously mentioned.

In order to avoid the undesired air entry problem, a new and improved dynamic sealing system has been developed. In a preferred embodiment of the invention, a relatively smooth circular object such as the collar 26 is affixed to the shaft 24 for rotation therewith. The collar 26 is attached to the shaft by means of a set screw 46; however, other methods of attachment may be used. The collar 26 is slightly physically spaced from the top cover 34 (FIG. 4) by approximately from 0.005 to 0.050 inches. In a preferred embodiment of the present invention, the spacing is fixed in the range of 0.005 to 0.010 inches. The diameter of the collar 26 is larger than the diameter of the aperture 44 by at least 0.125 inches to assure that the collar 26 overlaps the top plate 34 by at least 0.0625 inches around the periphery of the aperture 44. Larger overlaps may be used; smaller overlaps reduce the effectiveness of the seal and allow some leakage. The above dimensions are based on a 0.625 inch aperture and a 0.750 inch diameter collar and may be altered for different diameter apertures. In addition, although a circular cross section aperture 44 is shown, the system according to the invention may be used to seal non-circular cross section apertures provided that the diameter of the collar 26 is larger than the largest cross sectional dimension of the aperture and that the collar 26 completely overlaps the aperture.

In operation, the rotation of the collar 26 imparts movement to the fluid in contact therewith. Both gases and liquids are affected in a similar manner; and the following discussion applies to any fluid. The movement of the fluid in contact with the collar 26 causes a zone of turbulence to be created around the collar, particularly around the periphery thereof where the tangential velocity is the greatest. The turbulence is particularly great in the area of overlap between the collar 26 and the top plate 34 due to the shear stresses generated by the fluid by the difference in velocity between the collar 26 and the top plate 34. For example, as the collar 26 rotates, the molecules of fluid immediately adjacent to the periphery of the collar 26 are caused to move at approximately the same velocity as the collar. The movement of the molecules near the perimeter of the aperture 44 is restrained by the stationary top plate 34; and hence the movement of the molecules immediately adjacent the aperture 44 is minimal. The sharp velocity gradient between the high speed molecules adjacent the perimeter of the collar 26 and the low speed molecules immediately adjacent the perimeter of the aperture 44 generates a localized area of high turbulence 48 in the space between the collar 26 and the top plate 34 where the collar 26 overlaps the top plate. The area of turbulence is designated by the curved lines connecting the collar 26 and the top plate 34 in FIG. 4. The highly turbulent area just described forms a turbulence barrier to prevent the flow of fluid from the area above the plate 34 into the pump housing 22 and the leakage of fluid from the housing 22 into the area above the top plate.

When a pump utilizing the seal according to the instant invention is used in conjunction with a photocopying machine such as the one shown in FIG. 1, the liquid developer is drawn into the pump housing 22 only through the inlet aperture 42. When the developer tank 12 is relatively full, the collar 26 is immersed in developer liquid; however, due to the smooth surface of the collar 26, the area of turbulence is confined to the high velocity gradient area in the gap between the collar 26 and the top plate 34. Hence, the developer liquid is not unnecessarily agitated by the rotating collar; and the problems associated with the turbulence created by slinger type seals are avoided. As the liquid developer is used by the machine, the level of the developer eventually drops below the level of the top plate 34 to a level such as the level designated by the horizontal lines 50 of FIG. 4. The collar 26 is then exposed to air and generates air turbulence around the periphery of the aperture 44 as previously described. The air turbulence thus generated acts as a barrier to prevent the entry of air into the housing 22 or the leakage of liquid therefrom. As a result, the machine can continue to operate until the developer tank is substantially empty, thereby increasing the allowable time interval between refilling and assuring that most of the liquid developer present in the tank has been used before fresh developer is added.

Although the non-contacting seal according to the invention has been described in the environment of a pump for a photocopying machine, it should be noted that the seal according to the invention is applicable to various apparatus wherein it is desired to prevent the flow of fluid around a rotating shaft. In addition, modifications which may be readily made by one skilled in the art, including but not restricted to minor changes in the shape of the collar 26 and the aperture 44, still fall within the scope and spirit of the invention. The details of the illustrated embodiment are not intended to limit the scope of the present invention as set forth in the following claims.

What is claimed is:

1. A pump for pumping liquids comprising:

a rotatable impeller immersible into the liquid to be pumped;

a stationary submersible housing surrounding said impeller, said housing having an inlet port, an outlet port and a first wall disposed above said impeller, said first wall having an aperture defined therein above said impeller;

an impeller drive shaft engaging said impeller and extending upwardly through said aperture, said drive shaft having a diameter substantially smaller than the diameter of said aperture and positioned within said aperture to define a substantial, uninterrupted, annular space around the entire periphery of said drive shaft between said drive shaft and the edges of the wall defining said aperture, said annular space being sufficiently large to permit free flow of the pumped liquid and air therethrough;

means for generating an annular area of turbulence around the periphery of said aperture, said turbulence generating means including a collar affixed to said drive shaft in spaced relationship with said first wall, said collar having a radially extending surface uninterruptedly spaced in an opposing, substantially parallel relationship approximately 0.005 to 0.050 inches from said first wall, said collar being larger than said aperture and positioned completely to overlap the entire periphery of said aperture by at least 0.0625 inch, said collar being rotatable by said drive shaft upon the rotation of said impeller for generating the annular area of turbulence around the entire periphery of said aperture in the area between said wall and said surface for impeding the flow of air into and the flow of liquid out of said housing through the annular space between said drive shaft and said wall when the level of the liquid being pumped falls below the level of said aperture; and a motor disposed above said impeller and engaging said drive shaft for rotating said drive shaft and said collar.

2. A pump as recited in claim 1 wherein said aperture is substantially circular, said first wall is substantially planar and said collar is substantially circular and disc shaped and has a diameter at least 0.125 inch larger than the diameter of said aperture.

* * * * *